US007673428B1

(12) United States Patent
Smythe

(10) Patent No.: US 7,673,428 B1
(45) Date of Patent: Mar. 9, 2010

(54) BOXABLE MESH ADHESIVE DRYWALL CORNER TRIM

(76) Inventor: Timothy Smythe, 4017 NW. North Cliff, Bend, OR (US) 77701

( * ) Notice: Subject to any disclaimer, the term of this patent is extended or adjusted under 35 U.S.C. 154(b) by 63 days.

(21) Appl. No.: 11/657,389

(22) Filed: Jan. 24, 2007

(51) Int. Cl.
*E04B 2/00* (2006.01)

(52) U.S. Cl. ..... 52/255; 52/287.1

(58) Field of Classification Search ..... 52/254, 52/255, 287.1; 428/77
See application file for complete search history.

(56) References Cited

U.S. PATENT DOCUMENTS

| | | | | | |
|---|---|---|---|---|---|
| 658,386 | A * | 9/1900 | Mitchell | 52/257 |
| 2,234,701 | A * | 3/1941 | Lyman | 52/417 |
| 3,255,561 | A * | 6/1966 | Cable | 52/255 |
| 3,765,138 | A * | 10/1973 | Bentle | 52/255 |
| 4,792,473 | A | 12/1988 | Vitale | 428/40 |
| 5,131,198 | A * | 7/1992 | Ritchie et al. | 52/287.1 |
| 5,246,775 | A | 9/1993 | Loscuito | 428/383 |
| 5,442,886 | A | 8/1995 | Iacobelli | 52/255 |
| 5,604,001 | A | 2/1997 | Schold | 428/41.8 |
| 5,711,124 | A | 1/1998 | Stough et al. | 52/417 |
| 5,904,016 | A | 5/1999 | Koenig et al. | 52/255 |
| 6,001,200 | A | 12/1999 | Hibler | 156/71 |
| 6,073,406 | A * | 6/2000 | Kearney | 52/287.1 |
| 6,119,420 | A | 9/2000 | Koenig et al. | 52/255 |
| 6,148,573 | A | 11/2000 | Smythe | 52/255 |
| 6,226,957 | B1 | 5/2001 | Stough | 52/745.2 |
| 6,295,776 | B1 * | 10/2001 | Kunz et al. | 52/255 |
| 6,413,606 | B1 | 7/2002 | Calderon | 428/61 |
| 6,447,872 | B1 * | 9/2002 | Larson | 428/77 |
| 6,615,557 | B2 * | 9/2003 | Smythe, Jr. | 52/287.1 |
| 6,691,476 | B1 * | 2/2004 | Kunz | 52/287.1 |
| 6,722,092 | B2 * | 4/2004 | Kunz et al. | 52/255 |
| 6,779,313 | B2 | 8/2004 | Smythe | 52/255 |
| 7,036,284 | B1 * | 5/2006 | Larson | 52/506.1 |
| 7,214,434 | B2 * | 5/2007 | Dalgleish et al. | 428/537.5 |
| 7,383,668 | B1 * | 6/2008 | Kunz | 52/255 |
| 2003/0089058 | A1 * | 5/2003 | Kunz et al. | 52/255 |
| 2004/0023002 | A1 | 2/2004 | Wyndham | 428/156 |
| 2006/0070324 | A1 | 4/2006 | Daly, IV | 52/287.1 |
| 2006/0101746 | A1 * | 5/2006 | Smythe | 52/287.1 |
| 2006/0254170 | A1 | 11/2006 | Goldman | 52/366 |
| 2006/0283115 | A1 | 12/2006 | Robertson | 52/364 |

* cited by examiner

*Primary Examiner*—Richard E Chilcot, Jr.
*Assistant Examiner*—Brent W Herring
(74) *Attorney, Agent, or Firm*—Clifford Kraft

(57) ABSTRACT

A boxable drywall corner trim that can include an elongated semi-rigid member that forms a pair of flanges joined at a grooved hinge along a centerline. Each of the flanges can have a thinner part and a thicker part joined at a step that is approximately parallel to the centerline a predetermined distance from the centerline. The thicker part of the flanges can form a protruding nose member that makes the piece boxable by preventing the cross-over of wet drywall mastic or mud from one flange to the other. The thinner portion of the flange may optionally be perforated with a pattern of punched holes of any configuration throughout the flange assembly. The piece can have a wall-facing paper or other fibrous layer of material that has a tacky adhesive on its wall-facing side. The adhesive can be in a pattern of dots, ridges, lines or any other pattern, or the adhesive can be continuously coated on the surface. This tacky adhesive allows the piece to be applied to the corner, moved, removed and re-applied if necessary.

8 Claims, 4 Drawing Sheets

BOXABLE MESH ADHESIVE DRYWALL CORNER TRIM

BACKGROUND

1. Field of the Invention

The present invention relates generally to the field of drywall corner trim and more particularly to a boxable mesh adhesive drywall corner trim.

2. Description of the Prior Art

Drywall corner trim originally was metal corner bead. Several years ago, a new type of corner trim was invented that was a hinged plastic with paper covering. This type of trim is described in U.S. Pat. No. 6,148,573. U.S. Pat. No. 6,148,573 is hereby incorporated by reference. One problem with existing corner bead and trim products is that they were not boxable. By boxable, I mean the ability to put wet mud on both sides of the product without waiting for one side to dry. Historical trim products required the application of mastic or drywall mud compound to one side of a corner i.e. right or left; allowing that side to dry (generally throughout the construction project); sanding that side, and then applying wet mud to the second side, allowing it to dry, and finally sanding the second side.

U.S. Pat. No. 6,779,313 describes a boxable corner trim product that by the shape of the outer surface, allows wet mud to be applied (from a mud box) to both sides. This can greatly reduce the number of steps required to finish a construction job. This type of product is generally designed to be attached to the wall (drywall) using only wet mud behind the piece. However, on many occasions, it is also economical and desirable to attach the piece with adhesive. U.S. Pat. No. 6,779,313 is hereby incorporated by reference.

It is well known in the drywall industry that many corner trim materials are difficult to apply using mechanical methods of attachment such as nails or adhesive, and are very susceptible to damage after application and finishing. This can be caused by any impact or movement of the building. The damage usually takes the form of cracked edges at the flange edge of the material as the dried mud cracks during impact, or building structural movement. The result can be that the flange of the trim material delaminates and partially separates form the surface of the wall.

To try to mitigate damage, installers commonly use separate adhesives to better bond the corner trim material to the drywall corner and apply mesh material over the flange edge of the trim after installation. They then apply their first layer of mud over the mesh. A commonly used type of adhesive is a spray-on type. The mesh material is usually fiberglass that has some adhesive applied to one side (the side that faces the wall).

U.S. Pat. No. 5,442,886 teaches a corner piece with mesh and a layer of adhesive. One of the major problems with that system is that the piece is not boxable. Another problem is that the continuous layer of adhesive taught does not adhere uniformly to the drywall board. U.S. Pat. No. 5,442,886 is hereby incorporated by reference. U.S. Published Patent Application 2006/0283115 teaches a different corner trim with mesh. This system has similar problems. Publication 2006/0283115 is hereby incorporated by reference.

It would be advantageous to have a corner trim material that allows the installer to take a pre-cut piece of material and simply stick it to the wall using its supplied adhesive and mesh material. The adhesive can hold the corner trim material until an initial layer of mud or joint compound or other mastic can be applied for a permanent bond. The mastic material can migrate through the openings in the mesh and bond to the wall in a very strong, damage resistant fashion.

SUMMARY OF THE INVENTION

The present invention relates to a boxable mesh, adhesive drywall corner trim that overcomes the disadvantages of the prior art. The invention can combine adhesive, mesh and trim into a single product that allows for a quick, strong and economical installation.

A particular embodiment of the present invention includes an elongated semi-rigid member that forms a pair of flanges joined at a grooved hinge along the centerline. Each of the flanges can have a thinner part and a thicker part joined at a step that is approximately parallel to the centerline a predetermined distance from the centerline. The thicker part of the flanges form a protruding nose member that makes the piece boxable by preventing the cross-over of wet drywall mastic or mud from one flange to the other. The thinner part of the flange may optionally be perforated with a pattern of holes punched through the flange. The piece can have a wall-facing paper or other fibrous layer of material that has a tacky adhesive on its wall-facing side. The adhesive can be in a pattern of dots, ridges, lines or any other pattern, or the adhesive can be continuously coated on the surface. This tacky adhesive allows the piece to be applied to the corner, moved, removed and re-applied if necessary. In some embodiments of the invention, a layer of mesh material can be place on the room-facing surface of the flanges running generally from the region of the step out to the edge of the flanges or to a point a pre-determined distance beyond the edge of the flanges. This mesh layer can optionally have an adhesive on its wall-facing side. It can also have cover paper to protect the adhesive. Some embodiments of the invention can have a second paper or other fibrous material layer on the room-facing side of the flanges. This layer can be under or over the mesh layer. In the case where the mesh layer is trapped between the semi-rigid member and the outer paper layer, the mesh may or may not optionally penetrate into the plastic or other material of the semi-rigid member. When the entire piece is hot extruded, the mesh normally penetrates the plastic.

DESCRIPTION OF THE FIGURES

The present invention can be better understood by referring to several of the following drawings.

Several drawings and illustrations have been presented to better aid in understanding the present invention. The scope of the present invention is not limited to what is shown in the figures.

DESCRIPTION OF THE INVENTION

The corner trim of the present invention generally combines the advantages of a boxable trim product with mesh and adhesive; however, each of these is optional. A layer of mesh material may be bonded to the room-facing surface of at least one flange of the trim material. Generally, mesh is bonded on both flanges. The mesh material can be bonded so that it covers only the left and/or right flanges, or both, but does not cover the slightly protruding nose member that makes the piece boxable. The protruding nose member is prepared to accept paint or texture. The mesh material can optionally extend beyond the outside edge of the flange by a predetermined distance. The mesh material may optionally take the place of a paper flap commonly found on corner trim pieces. In some embodiments of the present invention, the mesh may be omitted or made of an alternative apertured or perforated material.

The wall-facing surface of the piece may have an adhesive coating prepared in a pattern of predetermined spacing and size. This pattern may be continuous, in the form of dots, in the form of ridges or in any other pattern. The pattern may optionally continuously cover the entire wall-facing surface of the piece. In a different embodiment, the adhesive may be pre-applied to a fibrous material that is in turn bonded to the core or semi-rigid member of the trim material.

The mesh material may have an additional adhesive applied to one side. This side would be assembled to the piece construction with the adhesive side of the mesh tape corresponding to the wall side of the trim material. This side is against the drywall material at installation. The adhesive applied to the wall-side of the trim material can be very tacky and repositionable. A possible adhesive material is a polyisobutylene adhesive.

The room-facing surface may be overlaid with fibrous material like paper that optionally covers the protruding nose. This material may also optionally overlay the flange and may cover the mesh (not generally extending beyond the outside edge of the flange).

The product may optionally have a layer of release paper known in the art applied over the sticky side of the trim material for ease in handling and packaging. This release paper can be pulled off by the installer when it is desired to use the product.

In some embodiments of the present invention, the mesh flap protruding from the flange edge can take the place of a paper flap. The preferred method is to have a separate paper or fibrous layer; however, it is possible to use the mesh alone with no paper or for paper to cover only the nose portion of the construction.

Figure 1:
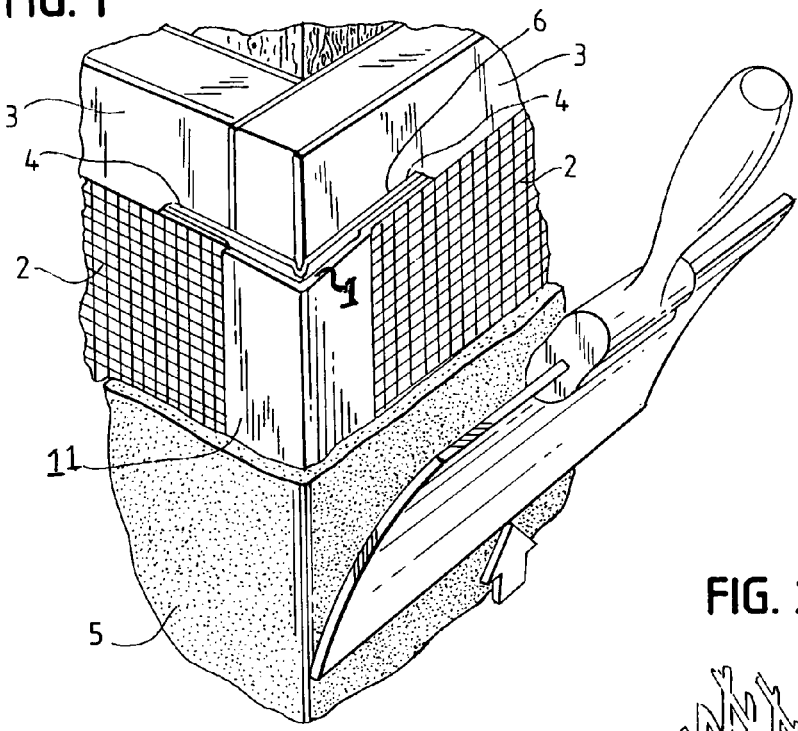
FIG. 1 shows the corner trim of the present invention being applied to a corner.

Turning to FIG. 1 a drywall corner can be seen with an embodiment of the mesh, adhesive trim of the present invention being applied. The trim piece is placed in contact with drywall 3 at an exterior or interior corner in preparation for a first layer 5 of drywall mud or other mastic compound shown being applied to the corner. An elongated, semi-rigid trim base 1 is preferably made of high impact plastic or equivalent material; however, it can be metal or any other semi-rigid material. The semi-rigid trim base 1 can be optionally covered with a paper (or other fibrous material) layer 11, and it can be prepared to directly receive paint of texture. As will be subsequently discussed, this base piece can be made boxable by incorporating a protruding center or nose 14 that extends out to a region 7 that is recessed to form a flange. The trim piece can be made with a rear or wall-facing paper layer 6 and a front surface or room-facing paper layer 11. If it is used, the room-facing fibrous layer 11 can cover the nose 14 of the piece and can be prepared to directly receive paint or texture. Both of these paper layers are optional and can be omitted. A layer of mesh 2 can be pre-applied to the piece so that it overlays the flange. The mesh 2 can be used on either one flange or both flanges. Generally, the adhesive side of the mesh (if it contains a separate adhesive) faces the drywall 3 (wall-facing). It is preferred for the mesh 2 to be pre-coated with a sticky adhesive layer on one side; however, mesh with no adhesive is within the scope of the present invention.

The inside paper (fibrous) layer 6 (or optionally the inside of the semi-rigid member 1 without paper) can contain adhesive 4. This is an adhesive layer separate from any adhesive that is on the surface of the mesh 2. This adhesive can be presented in several different physical configurations including, but not limited to, dots, rows and a continuously coated layer.

As stated, the trim piece of FIG. 1 can be made boxable by having the semi-rigid member 1 shaped so that it contains a protruding nose 14 formed from a step 7. The nose member forms an angle along a groove 15 (FIG. 2) that acts as a hinge. Because the nose member protrudes from the rest of the flange, it is possible to apply wet mud to both sides of the piece without the mud slopping over; hence, the piece is boxable.

Figure 2:
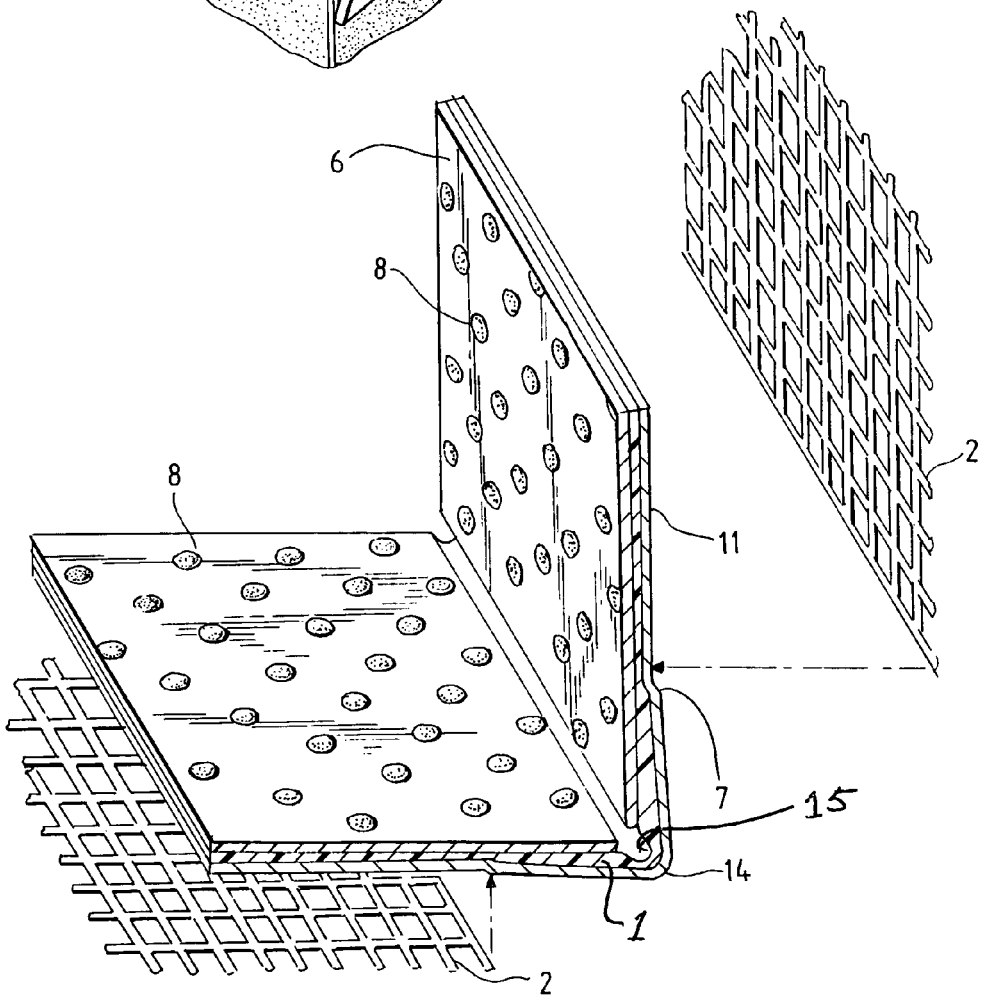
FIG. 2 shows details of the construction of an embodiment of the present invention that uses glue dots.

FIG. 2 shows a perspective view of the embodiment of FIG. 1 with the cross-section shown. The mesh 2 is shown separated from the piece ready for application to the piece on each side of the protruding nose member 14 along the flange. The mesh 2 can be overlaid onto a thin portion of the flange. It should be noted that in some embodiments of the present invention, the mesh can be omitted. FIG. 2 also shows one possible way that adhesive on the wall-facing side of the flange can be presented, namely in the form of adhesive dots 8. These dots 8 can be slightly raised and can be dense enough to provide a good bond to the drywall 3. As the installer presses the piece into position, the dots spread out forming larger bonding areas. The adhesive dots 8 can be applied directly onto the elongated semi-rigid base piece 1, or they can be applied on top of a wall-facing paper layer 6 if it is used.

Figure 3:
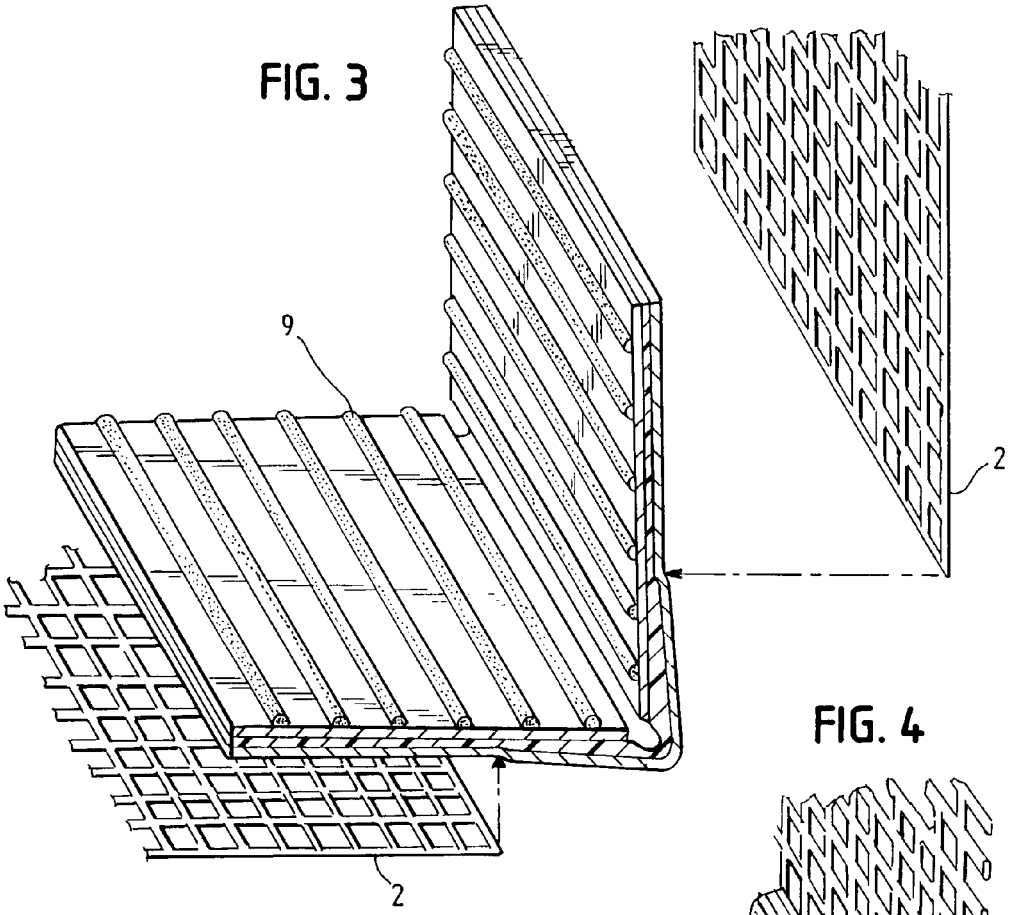
FIG. 3 shows details of the construction of an embodiment of the present invention that uses glue ridges.

FIG. 3 shows an embodiment of the present invention that uses an adhesive rib or row pattern 9. This pattern can take many different variations from the straight rows shown in FIG. 3. The rows can run either direction horizontally or vertically (or both in a cross-hatch pattern), or they can run diagonally or in a zigzag or wave pattern. Any pattern for placing the adhesive on the rear-facing part of the flange is within the scope of the present invention.

Figure 4:
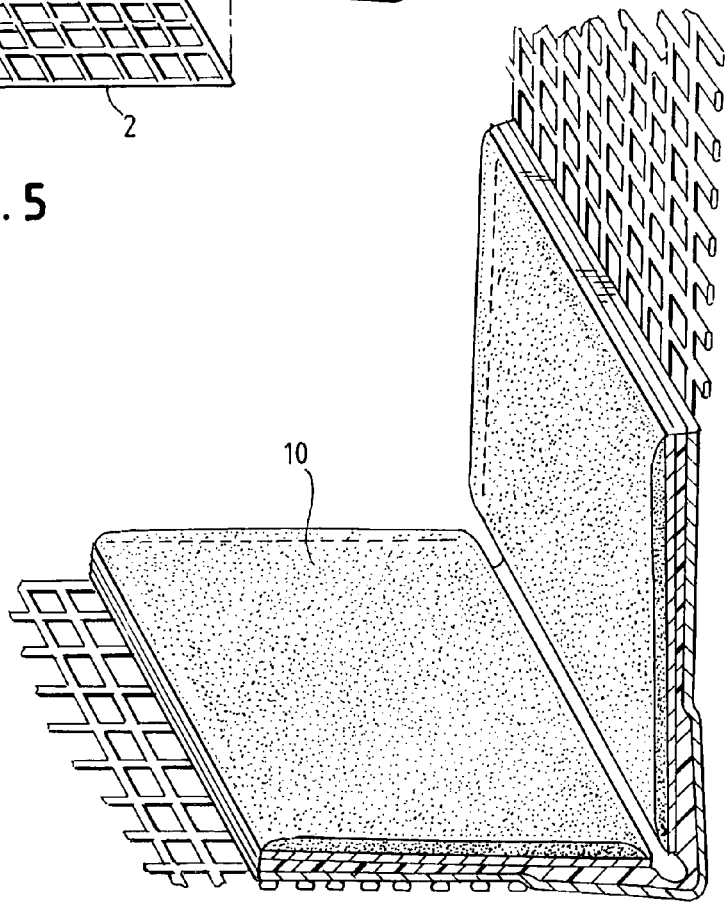
FIG. 4 shows details of the construction of an embodiment of the present invention that uses a flood-coating of adhesive.

FIG. 4 shows a different embodiment of the present invention where the adhesive coating 10 is applied continuously in what is normally called a flood coating.

Figure 5:
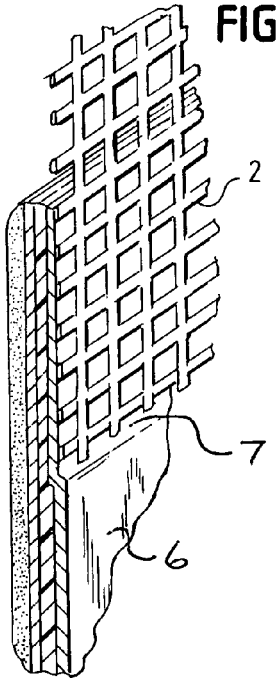
FIG. 5 shows an embodiment of the present invention shown in FIG. 4 but from the room side. The Mesh is overlaid on the room side of the thin portion of the flange.

FIG. 5 shows different view of the embodiment of FIG. 4 where the mesh 2 layer can be more clearly seen on the flange running away from the nose of the piece and starting at the step 7. In this embodiment of the invention, the mesh 2 can be laid directly on top of a room-facing layer of paper 11. As previously stated, this layer of paper is optional.

Figure 6A:
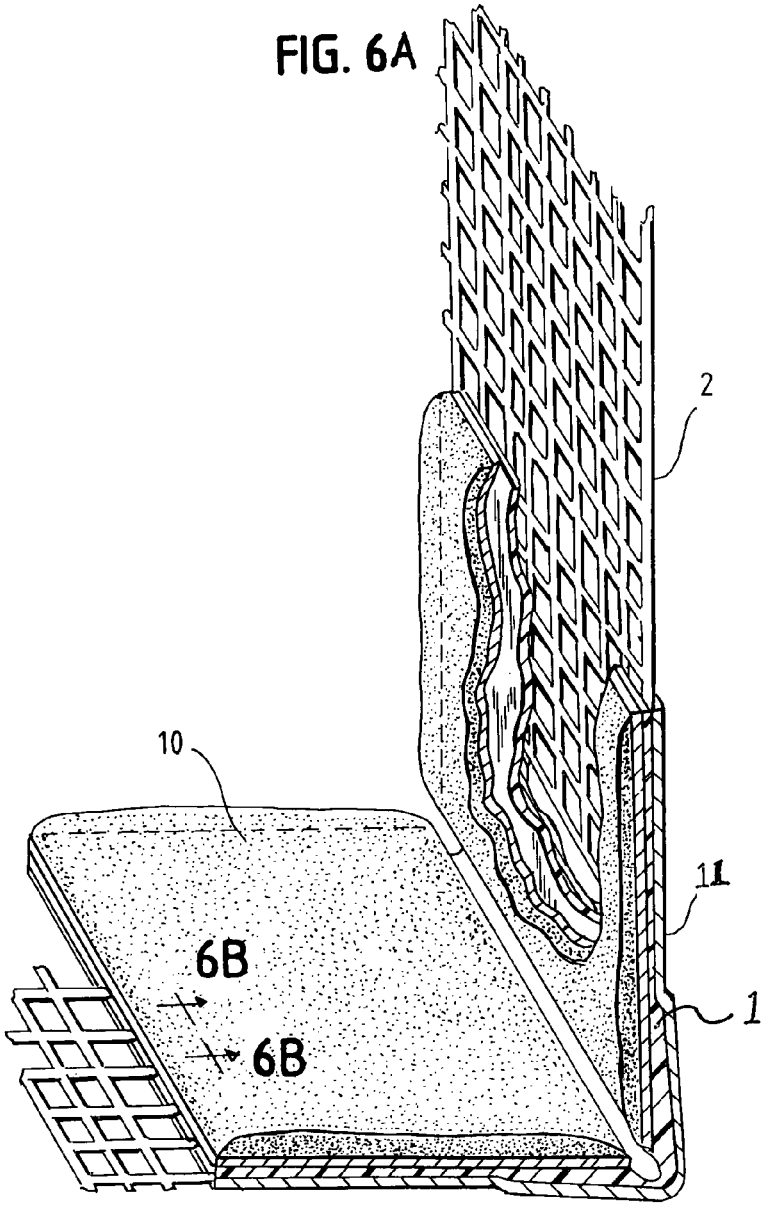
FIG. 6A shows a detail of the internal construction of an embodiment of the present invention where the mesh is trapped under an outer paper layer.

FIG. 6A shows a different embodiment of the invention where the mesh 2 is captured between the flange core 1 (the semi-rigid member) and the outer or room-facing cover layer 11 which is prepared to directly receive paint or texture. The mesh flap 2 can optionally take the place of a paper flap.

Figure 6B:
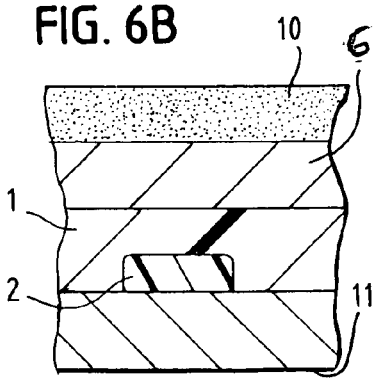
FIG. 6B shows a section of the embodiment of FIG. 6A where the mesh is molded into the plastic.
Figure 6C:
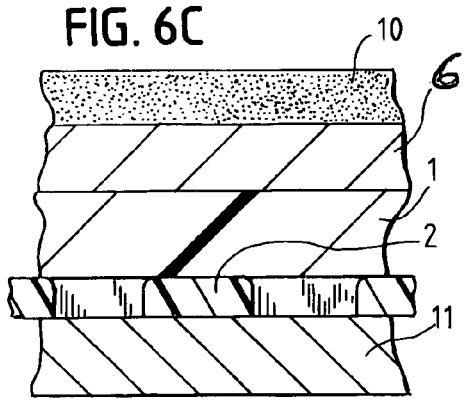
FIG. 6C shows a section of the embodiment of FIG. 6A where the mesh is not molded into the plastic but is captured between the plastic and the outside (room side) outer layer.

FIGS. 6B-6C show a section from FIG. 6A showing the laminated structure in detail. The wall-facing cover layer 6 can be directly bonded to the semi-rigid trim base 1. The adhesive layer 10 can be continuously coated on top of the wall-facing cover layer 6. The mesh 2 is captured between the semi-rigid trim base 1 and a room-facing paper layer 11 that is prepared to directly receive paint or texture. In FIG. 6B, the mesh segment 2 is applied to the semi-rigid piece 1 while the plastic is liquid and is hot extruded along with the other layers. Hence, in FIG. 6B, the mesh 2 actually is recessed into the plastic. The section of FIG. 6C shows the case when the mesh 2 is attached to the plastic semi-rigid layer 1 cold and hence does not penetrate into the plastic.

Figure 7:
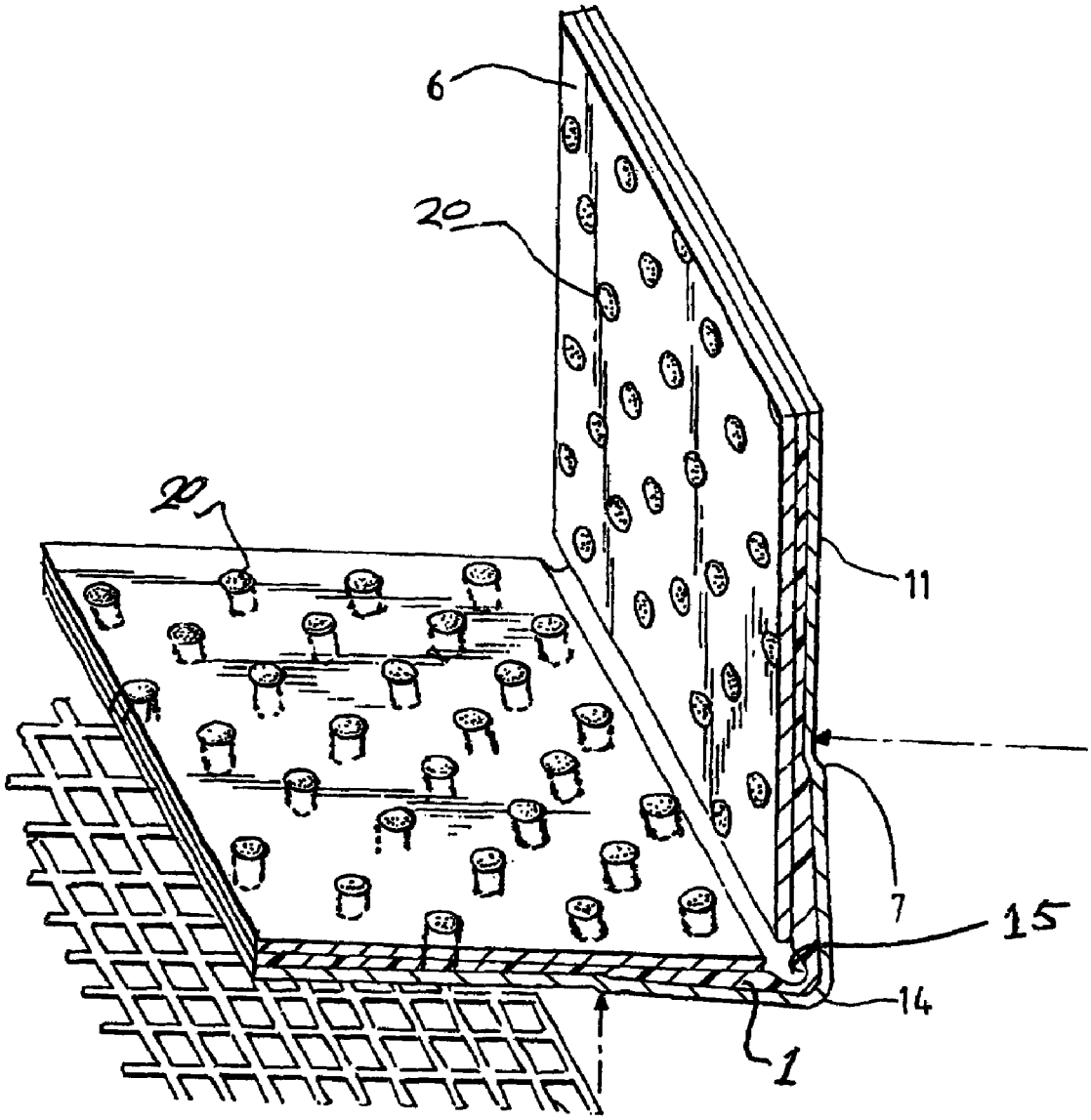
FIG. 7 shows an embodiment of the invention with a plurality of holes punched through the flange.

FIG. 7 shows an alternate embodiment of the invention with holes 20 punched through the flange.

Several descriptions and illustrations have been provided to aid in understanding the various embodiments of the present invention. One skilled in the art will understand that there are numerous changes and variations that can be made without departing from the spirit of the invention. Each of these changes and variations is within the scope of the present invention.

I claim:

1. An extruded corner drywall trim capable of being applied to a corner and wet-mudded on both sides comprising:

a pair of semi-rigid elongated plastic flanges each with a wall-facing surface and a room-facing surface joined edge-to-edge lengthwise along a centerline, wherein said flanges can flex about said centerline;

each of said flanges having a thinner region and a thicker region separated by a step, said step being approximately parallel to the centerline, the thicker region forming a protruding nose member along said centerline having a room-facing surface prepared to directly receive paint or texture, and wherein said thinner region has a flat or tapered continuous surface extending away from said step to an edge, said step and said flat or tapered continuous surface forming a region that prevents crossover of wet mud from one of said flanges to the other of said flanges; and a layer of mesh material or apertured material or perforated material on each of said flanges extending along said continuous surface approximately from the step to and beyond the edge of each of said flanges for a predetermined distance; and wherein said mesh material, apertured material or perforated material is captured between a fibrous layer and each of said flanges and wherein the wall-facing surface of said flanges include regions coated with adhesive;

wherein said flanges include a plurality of punched holes;

wherein said mesh penetrates into each of said flanges;

wherein said adhesive is tacky, allowing said drywall trim be applied, repositioned, removed and re-applied.

2. The corner trim of claim 1 wherein said protruding nose is covered with a fibrous layer.

3. The corner trim of claim 1 wherein said regions coated with adhesive are dots.

4. The corner trim of claim 1 wherein said regions coated with adhesive are ridges.

5. The corner trim of claim 1 wherein the entire wall-facing surface of said flanges are coated with a continuous layer of adhesive.

6. The corner trim of claim 1 wherein said adhesive is tacky, whereby said trim piece can be applied, repositioned, removed and re-applied.

7. The corner trim of claim 1 wherein a wall-facing surface of said mesh is coated with an adhesive.

8. The corner trim of claim 1 wherein the room-facing surface of said flanges is coated with a fibrous layer.

* * * * *